US005171397A

United States Patent [19]

Arnold

[11] Patent Number: 5,171,397

[45] Date of Patent: Dec. 15, 1992

[54]. SELF-CUTTING TAPE DISPENSER

[76] Inventor: John B. Arnold, 3 Maple St., Inglis, Fla. 32649

[21] Appl. No.: 473,735

[22] Filed: Feb. 2, 1990

[51] Int. Cl.[5] ..... B32B 31/18

[52] U.S. Cl. ..... 156/523; 156/527; 156/574; 156/577; 156/579

[58] Field of Search ..... 156/250, 522, 523, 527, 156/530, 574, 577, 579; 225/6, 10, 51, 82

[56] References Cited

U.S. PATENT DOCUMENTS

| | | | |
|---|---|---|---|
| 2,927,710 | 3/1960 | Raber | 156/577 |
| 3,156,603 | 11/1964 | Robinson | 156/577 |
| 3,843,439 | 10/1974 | Rohlwing | 156/577 |

FOREIGN PATENT DOCUMENTS

| | | | |
|---|---|---|---|
| 370671 | 4/1939 | Italy | 156/527 |

*Primary Examiner*—Caleb Weston
*Attorney, Agent, or Firm*—Edward M. Livingston

[57] ABSTRACT

A tape dispenser (6) is provided (FIGS. 7, 8 and 9) having a movable cover and keeper (27) which slides into a circumferential housing (5) to keep a roll of tape (2) on an axle (3) and hold a brake plate (28) in a circumferential housing (5). The cover (27) has an opening (29) for inserting the thumb to push against the brake plate (28) which operates as a brake when pressed against the roll of tape (2) inside the dispenser (6) by pushing the roll of tape (2) against the housing back (30) to prevent the roll of tape (2) from rotating when a tape-cutting blade (7) at the outside wall of the dispenser is pushed against the tape and given a slight right or left twist to cut it. Plane surfaces (14 and 17) are provided adjacent to the cutting blade (7) for pressing the tape against an object (13) to which tape is being attached to secure firm attachment of the tape before it is cut with the blade. Only one hand is necessary to firmly apply and cut tape by using this dispenser. Once the roll of tape is finished the dispenser (6) is easily refillable by merely putting a finger in an opening (32) which pushes the unit apart for easy replacement of the roll of tape.

9 Claims, 2 Drawing Sheets

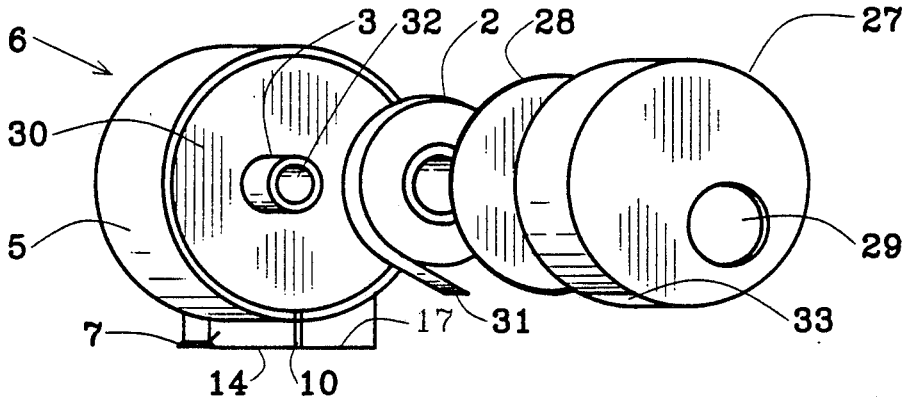
FIG. 7
FIG. 8
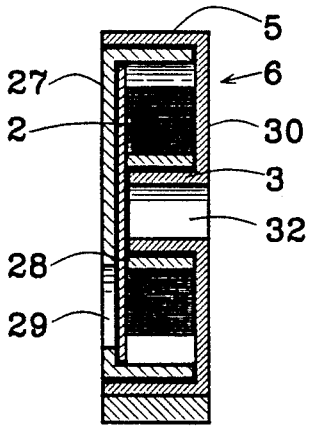
FIG. 9
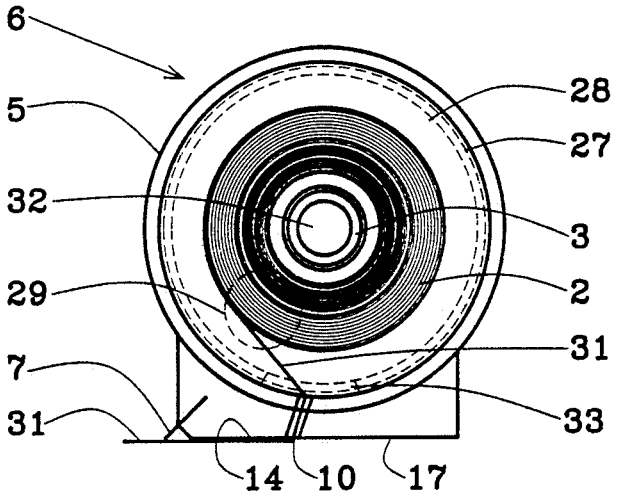
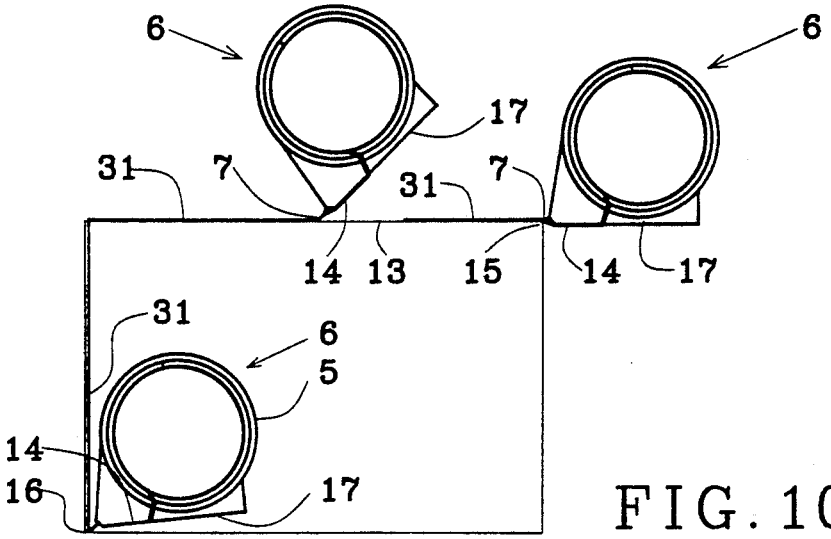
FIG. 10

SELF-CUTTING TAPE DISPENSER

This invention relates to tape dispensers and particularly to a tape dispenser with a friction brake against rotation of a roll of tape in the dispenser to aid in cutting the tape to facilitate ease and speed of operation of the dispenser with one hand.

Since the invention of transparent tape there have been many and various hand-held tape dispensers. Some are quite sophisticated with various cogs and working parts. Others are relatively simple. One main limitation of both the complex and the simple dispensers is that they are difficult to operate fast and effectively with one hand. The problem has not been recognized as related to arresting rotation of the roll of tape when cutting the tape with a blade attached to the outside of the dispenser. Some have means for arresting excessive dispensing of tape but not to hold it for cutting it easily with one hand and also to prevent excessive unrolling of tape in the manner accomplished by this tape dispenser.

Examples of Prior patents which have advanced the art of dispensers with mechanisms different from this invention include the following:

| | | | |
|---|---|---|---|
| U.S. Pat. No. | 4,775,084 | Morikami et al. | 1988 |
| U.S. Pat. No. | 4,792,375 | Lin | 1988 |
| U.S. Pat. No. | 4,640,167 | Stusack et al. | 1987 |
| U.S. Pat. No. | 4,262,835 | Wrobel | 1981 |
| U.S. Pat. No. | 4,069,958 | Strauss | 1978 |
| U.S. Pat. No. | 3,971,280 | Inka | 1976 |
| U.S. Pat. No. | 3,745,086 | Parker | 1971 |
| U.S. Pat. No. | 3,283,975 | Sebesta | 1965 |

The Morikami patent has a set of gears operated by a plunger knob to unroll and cut off tape of a length determined by how many times the plunger knob is pushed. The Lin patent teaches a mechanism for holding and cutting tape by pressing the sides before the tape is dispenses. The other patents found in this area differ in still other ways from this invention.

SUMMARY OF THE INVENTION

One object of this invention is to provide a tape dispenser which can be operated easily, rapidly and effectively with one hand.

A second object is to secure effective bonding of the tape to an object when operating the dispenser with one hand.

Another object is to hold the tape securely between a taped object and the roll of tape to cut the tape easily with one hand.

A further object is to provide a dispensing and cutting projection which can apply and cut the tape precisely in corners and at edges of surfaces to be taped.

An even further object to to provide a most inexpensive dispenser that does not increase the effective cost of tape.

An overall object is to provide a dispenser which is reusable over a long period of time and yet so low in cost that it can be disposed of economically.

BRIEF DESCRIPTION OF THE DRAWINGS

This invention is described in detail with reference to preferred embodiments illustrated in the accompanying drawings in which:

This invention is described by claims in relation to a description of preferred embodiments illustrated in the following drawings in which:

FIG. 7 is a perspective exploded view of the most preferred embodiment of the tape dispenser employing an interior brake plate;

FIG. 8 is a side cross-sectional view of the embodiment of FIG. 7;

FIG. 9 is a side view of the embodiment of FIG. 7; and

FIG. 10 illustrates the flat-surface-taping embodiment with this invention being employed to apply and to cut tape at different surfaces of an object being taped.

DESCRIPTION OF PREFERRED EMBODIMENTS

Figure 1:
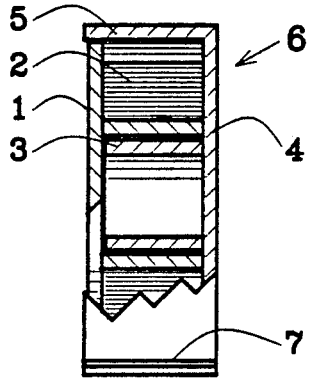
FIG. 1 is a cutaway end view of one embodiment of the invention usable to apply tape to a flat surface having a flat movable sidewall for breaking.
Figure 2:
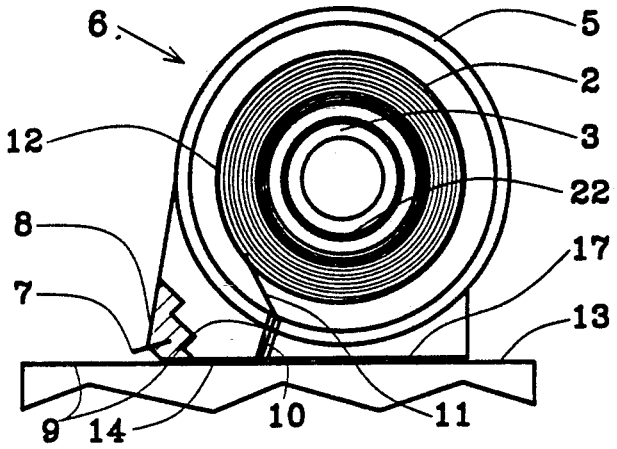
FIG. 2 is a plan view of the FIG. 1 embodiment from a side with the movable sidewall removed for revealing inside portions.

With reference to FIGS. 1 and 2, a movable sidewall 1 is pressable against a roll of tape 2 on a fixed axle 3 which is attachable to a base sidewall 4 that in turn is attachable to a circumferential housing 5 of a flat-surface-taping dispenser 6 with a tape-cutting blade 7 at a cutting projection 8. A tape section 9 is unrolled from the roll of tape 2 with a bonding side Il facing the opposite direction of the tapecutting blade 7. Positioning the roll of tape 2 on the axle 3 assures that the bonding side 11 of the tape section 9 will be in contact with a bondable surface 13. Tape-pressing-edge 14 can then be held against the tape section 9 and against a bondable surface 13 to secure bonding of the tape 9 against the surface 13 when the dispenser 6 is moved along the surface 13 while maintaining slight pressure of the dispenser 6 against the surface 13.

As illustrated in FIG. 10, when reaching either a terminal point of taping at an outside corner 15, a selected portion of a bondable surface 13 or an inside corner 16, the dispenser 6 can be raised or moved away slightly from the surface of the item being taped while simultaneously pushing movable sidewall 1 against the roll of tape 2 to arrest rotation of the roll thereby holding the tape in a secure position and cutting the tape easily and accurately at a desired terminal point of taping by pushing the blade 7 on the cutting projection 8 against the tape section 9.

As illustrated in FIG. 2, in addition to the tape-pressing edge 14 between the blade 7 and the dispensing orifice 10, the base of the housing 17 can both provide stability of the dispenser 6 when tape is being dispensed and a means for holding the dispenser 6 upright if desired when it is not being used or is resting at a terminal end of taping.

The entire process of taping and cutting the tape with this dispenser is naturally and easily adaptable to be accomplished with one hand while the other hand can be used for positioning items and surfaces to be taped. In particular, squeezing the sidewalls 1 and 4 while tipping the dispenser 6 and pushing the blade 7 against the tape 9 is a single and easy one-hand process. Pressing the tape 9 against a surface 13 with the tape-pressing edge 14 with one hand also is a very natural function.

Figure 3:
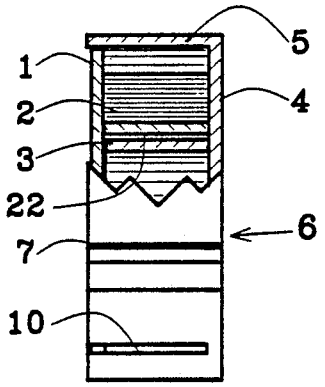
FIG. 3 is a cutaway end view of another embodiment of the invention usable in applying tape to curved or round/surfaces.
Figure 4:
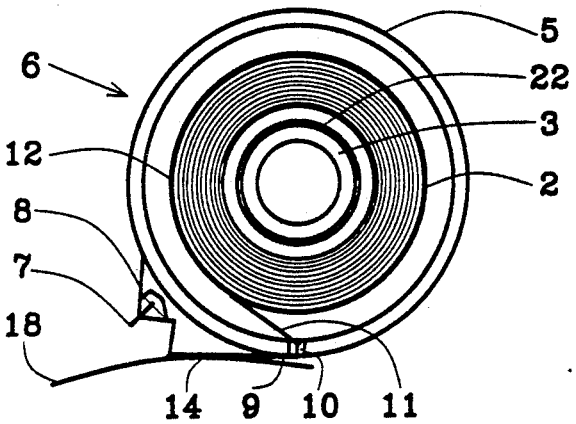
FIG. 4 is a plan view of the FIG. 3 embodiment from a side with the movable sidewall removed.

Referring to FIGS. 3 and 4, a curved-surface or round-surface dispenser 18 is provided without the flat housing base 17 in order to be more easily used in areas with compound or double surfaces. Also, the blade 7 can be positioned at a greater distance from the tape-pressing edge 14 in order to cut easily in counter-curve areas and to cut tape with a rolling motion when taping items such as pipes and electrical cords with various types of friction tape, rubber-insulation tape and medical tape.

Figure 5:
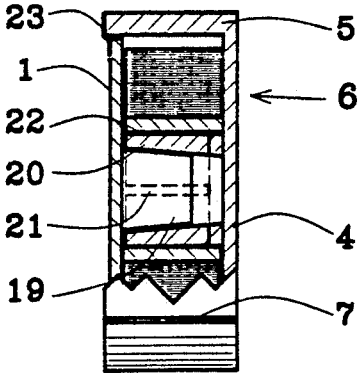
FIG. 5 is a cutaway end view of an embodiment with a variation of the braking means comprising the movable sidewall with cone-shaped brake.
Figure 6:
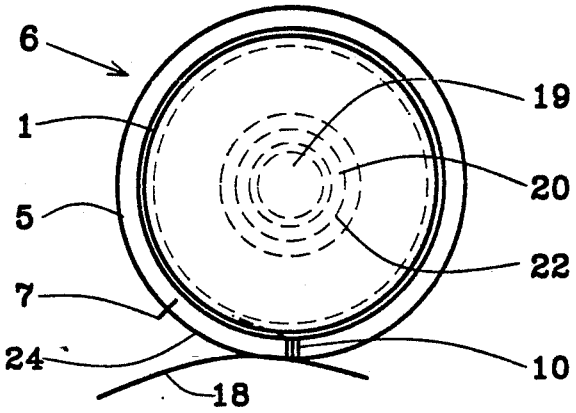
FIG. 6 is a side view of the FIG. 5 embodiment assembled and the interior portions represented by dashed lines.

Referring to FIGS. 5 and 6, a coned boss 19 on the movable sidewall 1 can be inserted into a matching internally-coned axle 20 having separation areas 21 and being flexible to cause the internally-coned axle 20 to be pressured against the tape-roll inside diameter 22 to act as a brake with the same handling motion as for the other embodiments of the invention. The movable sidewall 1 can be attached to the circumferential housing 5 with a strap or other flexible member 23 employed in the functional relationship of a hinge that allows pivotal as well as adequate linear travel of the movable sidewall 1. As illustrated also in FIG. 6, a curved pressing surface 24 can be employed between the dispensing orifice 10 and the cutting blade 7. The curved surface is particularly adaptable for such uneven and curved surfaces as occur for applying medical tape to medical dressings. FIG. 6 is shown with the movable sidewall with cone-brake in place and the internal components outlined with dashed lines. The coned-braking mechanism is not intended for any particular application, such as medical tape dispensing, but rather, either the side-braking contact or the coned-braking contact can be employed in any and all application. It is anticipated that the side-braking contact as illustrated in FIGS. 1–4 will be employed as the most preferred embodiment for most applications. The cone-braking mechanism is illustrated only as an alternative embodiment feature in FIGS. 5 and 6.

The most preferred embodiment of the device is shown in FIGS. 7, 8 and 9. As shown, the tape dispenser 6 is provided having a cover and keeper 27 which slides into the circumferential housing 5 keeping the roll of tape 2 on an axle 3 and holding brake plate 28 and the circumferential housing 5. The circumferential housing 5 also has a round opening 29 for a person's thumb to push the brake plate 28 when cutting the tape 31 and a dispensing channel 33 for the tape 31 to clear when tape and cover 27 is pushed inward causing the brake plate 28 to press the roll of tape 2 against the back of the housing 30 preventing the roll of tape 2 from rotating A roll of tape 2 is positioned on an axle 3 attached to the back of the housing 30 which is encircled by a circumferential housing 5. Plane surfaces 14 and 17 are provided adjacent to the cutting knife 7 for pressing the tape 31 against an object 13 to secure firm attachment of the tape 31 before it is cut with the knife 7. To cut the tape the dispenser 6 is tilted up and the knife 7 is pressed against the unrolled tape 31 while holding the brake plate 28 in and allowing a right or left twist of the dispenser 6 to cut the tape 31. To refill the dispenser 6, the user only needs to put his/her finger in an opening 32 in the center of the back housing 5 and push unit apart.

The circumferential housing 5 need not be rounded, particularly at the outside edge, but can be any desired shape. The housing only is referred to as "circumferential" with reference primarily to the roll of tape 2.

While specific embodiments of the invention have been described in detail hereinafter, various modifications therefrom are intended to fall within the scope of the invention as set forth in the appended claims

I claim:

1. A tape dispenser comprising:

a circumferential housing for holding a roll of tape;

a tape-dispensing orifice in the circumferential housing;

a tape-cutting blade extending outwardly from the outside surface of the housing at a select distance from the tape-dispensing orifice;

an axle for holding the roll of tape to one sidewall of the dispenser and extended inwardly towards an opposite sidewall which is movably attachable to the circumferential housing wherein the axle for the roll of tape is expandable in diameter against an inside of a roll of tape positioned thereon by means of a friction brake comprising a cone-shaped expander attachable to the movable sidewall and sized and shaped to fit inside of the expandable axle and to impart outward pressure of the expandable axle against a roll of tape positioned thereon when the movable sidewall is pressed inwardly towards the opposite sidewall to provide friction for arresting tape-dispensing rotation of the roll of tape, thereby holding the tape in position for cutting it with the tape-cutting blade when desired.

2. A tape dispenser according to claim 1 wherein movable attachment of one sidewall of the dispenser to the circumferential housing is comprised of:

a universal-direction hinge member attachable to an outside edge of the circumferential housing and to the movable sidewall such that the movable sidewall can be pivoted in a desired direction to an open position to allow a roll of tape to be positioned on the axle and then pivoted to a closed position and pressed against the roll of tape to provide friction for arresting tape-dispensing rotation of the roll of tape and thereby hold the tape in position for cutting it with the tape-cutting blade when desired.

3. A tape dispenser according to claim 1 and further comprising:

a tape-pressing surface extending between the tape-dispensing orifice and a position selectively near the tape-cutting blade.

4. A tape dispenser according to claim 3 and further comprising:

a tape-dispenser base extending a select distance in a plane tangentially to the outside surface of the circumferential housing from one side of the tape-dispensing orifice.

5. A tape dispenser according to claim 4 and further comprising a planar surface at each side of the tape-dispensing orifice forming a housing base extending a select distance tangentially to the outside surface of the circumferential housing.

6. A tape dispenser according to claim 5 wherein the tape-cutting blade is positioned at a select distance inwardly from an end of the planar surface towards the outside perimeter of the circumferential housing.

7. A tape dispenser according to claim 1 wherein movable attachment of the opposite sidewall of the dispenser to the circumferential housing is comprised of:

a sidewall axle parallel to the axle for the roll of tape and slidably attachable to the circumferential housing at a position selectively outward radially from the axle for the roll of tape; and pivotal and slidable attachment of the movably-attachable sidewall can be slid outward along the axis of the circumferential housing to open the circumferential housing for allowing a roll of tape to be positioned on the axle for the roll of tape and such that the movably-attachable sidewall can be slid inwardly on the sidewall axle against a roll of tape positioned on the axle for the roll of tape to provide friction for arresting tape-dispensing rotation of the roll of tape, thereby holding the tape in position for cutting it with the tape-cutting blade when desired.

8. A tape dispenser according to claim 1 wherein movable attachment of one sidewall of the dispenser to the circumferential housing is comprised of:

a sidewall hinge attachable to an outside edge of the circumferential housing and pivotally attachable to the movable sidewall such that the movable sidewall can be pivoted to an open position to allow a roll of tape to be positioned on the axle and then pivoted to a closed position and pressed against the roll of tape to provide friction for arresting tape-dispensing rotation of the roll of tape and thereby hold the tape in position for cutting it with the tape-cutting blade when desired.

9. A tape dispenser comprising:

a circumferential housing for holding a roll of tape;

a tape-dispensing orifice in the circumferential housing;

a tape-cutting blade extending outwardly from the outside surface of the housing at a select distance from the tape-dispensing orifice;

an axle for holding the roll of tape to one sidewall of the dispenser and extended inwardly towards an opposite sidewall which is movably attachable to the circumferential housing;

wherein movable attachment of the opposite sidewall of the dispenser to the circumferential housing is comprised of:

a sidewall axle parallel to the axle for the roll of tape and slidably attachable to the circumferential housing at a position selectively outward radially from the axle for the roll of tape; and pivotal and slidable attachment of the movably-attachable sidewall can be slid outward along the axis of the circumferential housing to open the circumferential housing for allowing a roll of tape to be positioned on the axle for the roll of tape and such that the movably-attachable sidewall can be slid inwardly on the sidewall axle against a roll of tape positioned on the axle for the roll of tape to provide friction for arresting tape-dispensing rotation of the roll of tape, thereby holding the tape in position for cutting it with the tape-cutting blade when desired;

wherein the opposite sidewall has an opening therein for insertion of a finger to push against a roll of tape; and a flat plate positioned between the opposite sidewall and the roll of tape so that the flat plate will act as a brake when pushed against the roll of tape and pushed by a finger inserted in the round opening in the opposite sidewall.

* * * * *